United States Patent [19]

Kraus et al.

[11] Patent Number: 4,826,456

[45] Date of Patent: May 2, 1989

[54] ELECTRICAL CONNECTOR WITH COMPLIANT SECTION

[75] Inventors: Robert D. Kraus; Rhonda L. Nemcovsky, both of Warren, Pa.

[73] Assignee: GTE Products Corporation, Stamford, Conn.

[21] Appl. No.: 133,850

[22] Filed: Dec. 16, 1987

[51] Int. Cl.[4] ..... H01R 13/41

[52] U.S. Cl. ..... 439/751; 439/82

[58] Field of Search ..... 439/751, 80–89; 29/879

[56] References Cited

U.S. PATENT DOCUMENTS

| | | | |
|---|---|---|---|
| 3,545,080 | 12/1970 | Evans | 29/629 |
| 3,634,819 | 1/1972 | Evans | 339/252 P |
| 3,783,433 | 1/1974 | Kurtz et al. | 339/17 C |
| 4,017,143 | 4/1977 | Knowles | 339/221 R |
| 4,066,326 | 1/1978 | Lovendusky | 339/221 M |
| 4,076,356 | 2/1978 | Tamburro | 339/17 C |
| 4,166,667 | 9/1979 | Griffin | 339/176 MP |
| 4,186,982 | 2/1980 | Cobaugh et al. | 339/17 C |
| 4,206,964 | 6/1980 | Olsson | 339/221 M |
| 4,443,053 | 4/1984 | Astbury | 339/221 R |
| 4,585,293 | 4/1986 | Czeschka et al. | 439/751 X |
| 4,691,979 | 9/1987 | Manska | 439/82 |

*Primary Examiner*—Eugene F. Desmond

*Attorney, Agent, or Firm*—William H. McNeill

[57] ABSTRACT

A "C" shaped compliant electrical contact has a thinned bight and thicker arms for better conformance to the shape of printed circuit board plated through holes. Less stress is set up in the boards and good contact is made with the hole. Additionally, the inner surface of the arms can be splined to aid the contact in conforming to the shape of the aperture.

3 Claims, 3 Drawing Sheets

ELECTRICAL CONNECTOR WITH COMPLIANT SECTION

TECHNICAL FIELD

This invention relates to electrical connectors and more particularly to such connectors having a compliant section. Still more particularly, it relates to such connectors for insertion into plated through holes in printed circuit boards.

BACKGROUND ART

Modern electronic apparatus makes extensive use of printed circuit boards employing plated-through-holes (PTH). As an alternative to soldering connectors in these holes, it has been proposed to use connectors which engage the hole by friction only. Such connectors generally employ a compliant section for engagement to provide good mechanical and electrical contact. It is desirable that minimum damage be done to the PTH so that such connectors can be removed and replaced. The compliant connectors generally available take several forms: the "eye-of-the-needle" approach, as shown in U.S. Pat. Nos. 3,545,080; 3,634,819; and 4,206,964; the "split beam" approach, shown in U.S. Pat. Nos. 4,066,326; 4,186,982; the opposed "C" sections shown in U.S. Pat. No. 4,701,140: and the single "C" section, shown in U.S. Pat. Nos. 3,783,433; 4,017,143; 4,076,356; and 4,166,667.

While some of these techniques work to a greater or lesser extent, all have one or more problems, such as cost of making; failure to form a good gas tight seal with the PTH; difficulty of insertion or removal; or, when used in high numbers in thin printed circuit boards, a tendency to warp the boards because of the pressure they exert on the apertures.

DISCLOSURE OF THE INVENTION

It is, therefore, an object of the invention to obviate the disadvantages of the prior art.

It is another object of the invention to enhance electrical connection in plated-through-holes.

Yet another object of the invention is the provision of an electrical connector for PTH's which achieves the above objects and, additionally, provides ease of insertion and removal with minimal plating damage.

These objects are accomplished, in one aspect of the invention, by the provision of an electrical contact which has a compliant portion which is substantially "C" shaped in cross-section. The "C" shape is formed from opposing arms which extend from a joined bight. The arms have a substantially uniform, given thickness and are splined along a major part of their length on their inner surface. The joined bight can have a thickness less than the given thickness.

The splined arms contract more readily and more evenly to allow them to conform to the aperture. The thinner, or relieved section of the bight also allows for more deflection of the arms. As the ends deflect, so does the thinner relieved area of the bight. The contact can be formed by standard stamping and swaging techniques at a competitive cost.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
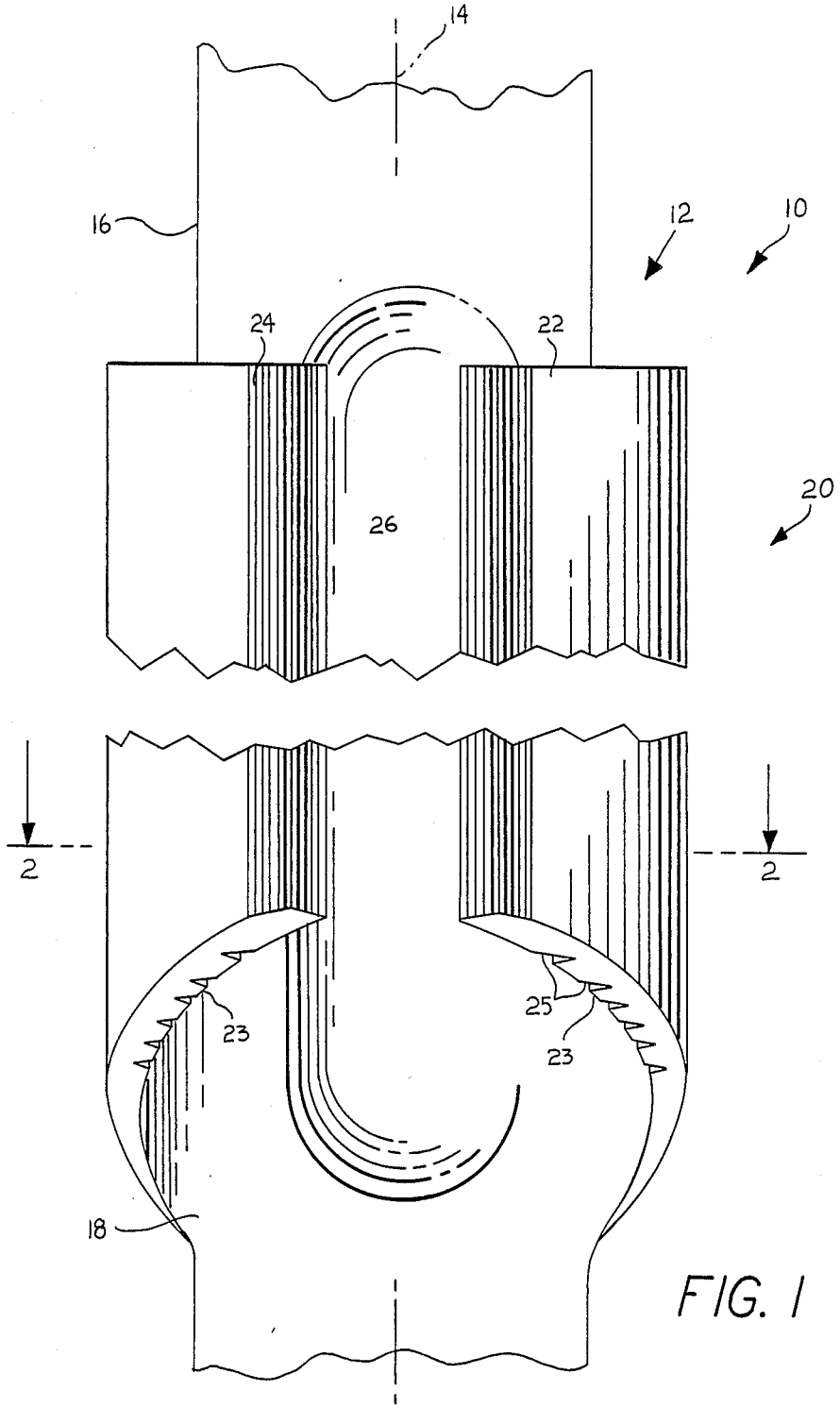
FIG. 1 is an elevational view of a contact of the invention.
Figure 2:
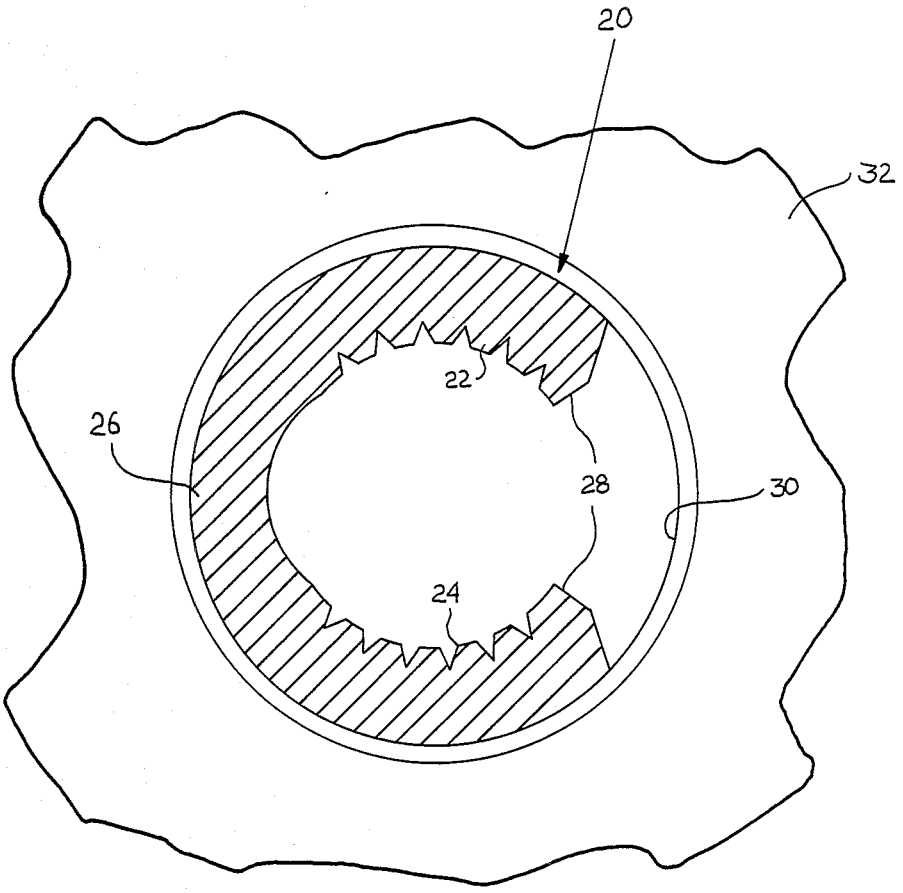
FIG. 2 is a sectional view taken along the line 2—2 of FIG. 1 and showing the contact in a plated through hole.

Referring now to the drawings with greater particularity, there is shown in FIG. 1 an electrical contact 10 having a body 12 with a longitudinal axis 14. First portion 16 and second portion 18 are separated by and connected to a compliant portion 20. The compliant portion 20 has a generally "C" shaped cross-section, more clearly seen in FIG. 2, which is formed from opposed arms 22 and 24 which extend from a joined bight 26. The arms 22 and 24 have a given, substantially uniform thickness, which can be, e.g., 0.008–0.009 inches, for a major part of their length. Additionally, the inner surface 23 of each of the arms is splined; i.e., longitudinally extending grooves 25 are provided therein. The grooves 25 can be triangular in cross-section, as shown, or they can have any other suitable configuration. The splined arms adapt more easily to the aperture configuration and reduce stresses thereon, while maintaining sufficient friction against the walls to achieve a good press-fit.

The grooves 25 can have a depth of 0.003–0.006" and a maximum width of 0.003–0.007", The number of grooves should be sufficient to allow the desired flexibility. The free ends 28 of the arms can be radiused or beveled, as shown.

The joined bight 26 has a thickness which is less than the thickness of the arms, e.g., about 0.005–0.006", thus providing more evenly distributed stresses about the plated through hole or aperture 30 in the printed circuit board 32. This is in conjunction with the splined arms. The aperture 30 can have an electrically conductive coating 33 thereon. This more even distribution of forces contributes to less hole deformation and, therefore, less accumulated stresses in the printed circuit board, which causes less warpage.

Figure 3:
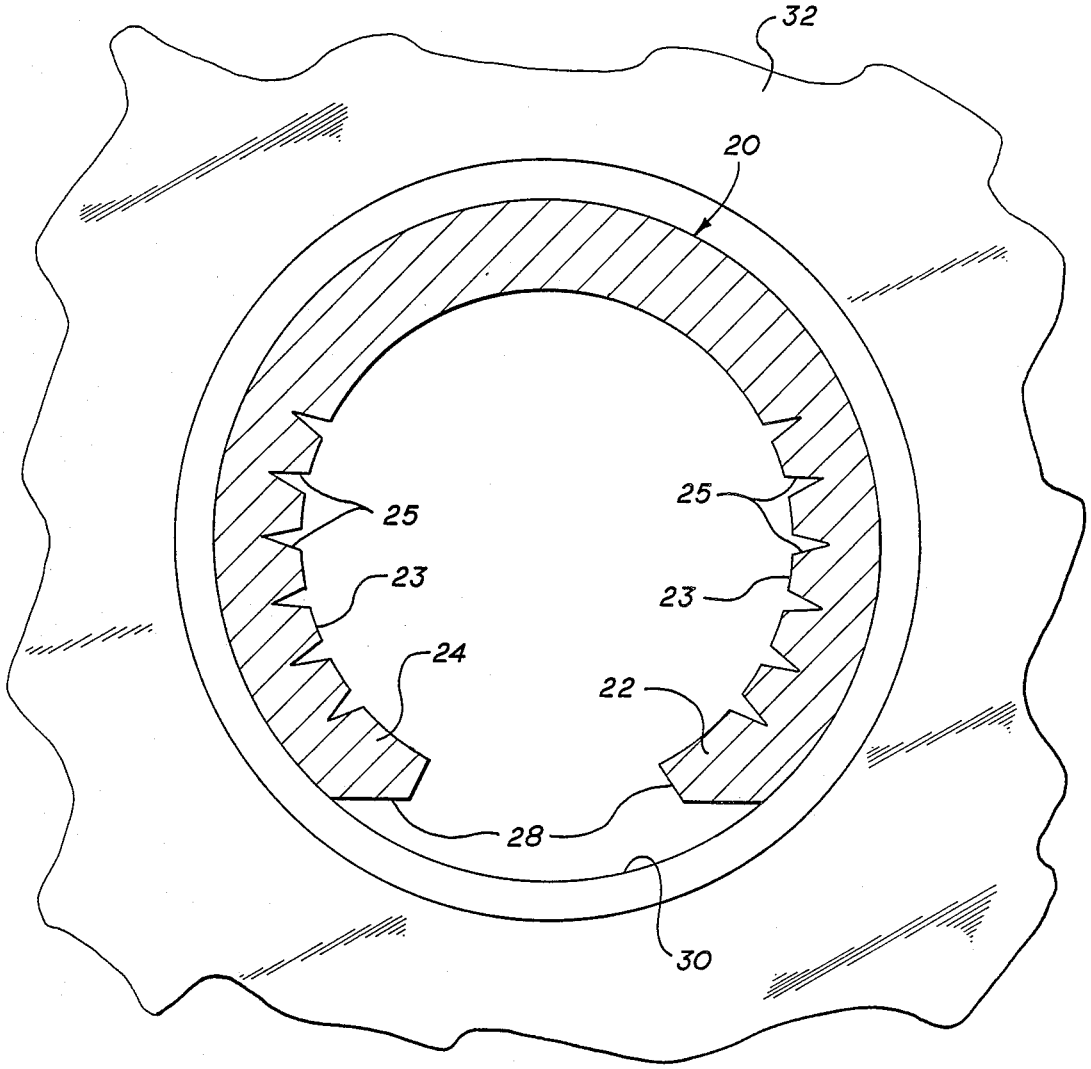
FIG. 3 is a sectional view similar to FIG. 2 showing an alternate embodiment.

Alternatively, as shown in FIG. 3, many of the benefits of the invention can be achieved using only the splined arms without the thinned bight. Either configuration provides greater contact surface area to the aperture 30 because the thinner portion of the bight and/or the splined arms more readily conform to the aperture.

Preferably, the contact can be made by stamping from sheet stock of phos-bronze having a thickness of 0.020".

The bight can be thinned by coining or swaging to a thickness of about 0.001"–0.003" less than the arms. When the "C" section is formed it typically will have a diameter of 0.046±0.001" and will be received within apertures having diameters of from 0.037" to 0.043". The grooves 25 can be swaged in or cut in.

While there have been shown and described what are at present considered to be the preferred embodiments of the invention, it will be apparent to those skilled in the art that various changes and modifications can be made herein without departing from the scope of the invention as defined by the appended claims.

We claim:

1. An electrical contact for insertion into an aperture in a printed circuit board wherein said contact comprises:

a compliant, aperture engaging portion having a generally "C" shaped cross-section formed from opposing arms extending from a joined bight;

said opposing arms engaging said aperture along their outer surface substantially to the ends thereof;

said arms having a substantially uniform given thickness and being splined along a major portion of their length and circumferential extent on their inner surface; and said joined bight having a thickness less than said given thickness.

2. An electrical contact comprising:

a body having a longitudinal axis with first and second spaced apart portions separated by and connected to a compliant portion;

said compliant portion having a generally "C" shaped cross-section formed from opposing arms extending from a joined bight;

said arms having a substantially uniform, given thickness and being splined along a major part of their length and circumferential extent on their inner surface; and said joined bight having a thickness less than said given thickness.

3. An electrical contact comprising:

a body having a longitudinal axis with first and second spaced apart portions separated by and connected to a compliant portion;

said compliant portion having a generally "C" shaped cross-section formed from opposing arms extending from a joined bight;

said arms having a substantially uniform thickness and being splined along a major part of their length and circumferential on their inner surface.

* * * * *